US006409057B1

(12) United States Patent
Kim

(10) Patent No.: US 6,409,057 B1
(45) Date of Patent: Jun. 25, 2002

(54) GARMENT HANGER WITH SIZE WINDOW

(76) Inventor: Ock Sung Kim, 20600 Homestead Rd. #14E, Cupertino, CA (US) 95014

( * ) Notice: Subject to any disclaimer, the term of this patent is extended or adjusted under 35 U.S.C. 154(b) by 191 days.

(21) Appl. No.: 09/729,681

(22) Filed: Dec. 5, 2000

(51) Int. Cl.[7] ..... A47G 25/14
(52) U.S. Cl. ..... 223/85; 40/322
(58) Field of Search ..... 223/85, 92, 88, 223/95; 40/322

(56) References Cited

U.S. PATENT DOCUMENTS

| | | | | |
|---|---|---|---|---|
| 2,801,036 A | * | 7/1957 | Klein | 223/85 |
| 4,198,773 A | * | 4/1980 | Batts et al. | 40/322 |
| 4,679,340 A | * | 7/1987 | Johansson | 223/85 |
| 5,586,697 A | * | 12/1996 | Johansson | 223/85 |
| 5,597,100 A | * | 1/1997 | Blitz | 223/85 |
| 5,893,493 A | | 4/1999 | Noivar | |
| 5,927,571 A | | 7/1999 | Richards | |
| 5,975,384 A | | 11/1999 | Manabat | |
| 6,000,588 A | | 12/1999 | Kolton, et al. | |
| 6,026,998 A | | 2/2000 | Brooks | |
| 6,029,868 A | | 2/2000 | Willingen, et al. | |
| 6,068,166 A | | 5/2000 | Kilian, et al. | |
| 6,070,772 A | | 6/2000 | Bond | |
| 6,073,819 A | | 6/2000 | Wing | |
| 6,116,482 A | | 9/2000 | Heiber | |
| 6,126,049 A | | 10/2000 | Gish | |

* cited by examiner

*Primary Examiner*—Bibhu Mohanty

(57) ABSTRACT

A hanger for clothes to be displayed as goods. The hanger comprises a hanger main body including an upper laterally extending member and a hook to be used for suspending the main body, connected to the upper laterally extending member. Additionally there is a window within the portion between the hook and the extending member, this window encases a polygon shaped size indicator and thus displays the sizes of the garments to consumers and sales people alike.

3 Claims, 3 Drawing Sheets

FIG. I

GARMENT HANGER WITH SIZE WINDOW

FIELD OF THE INVENTION

The present invention generally relates to a garment hanger, particularly to a garment hanger that displays information about the size of the garment, which is being displayed for easy identification.

BACKGROUND OF THE INVENTION

Many modified versions of the conventional hanger exist in the market today. re U.S. Pat. No. 6,126,049 to Gish discloses a non-slip clothes hanger which has a horizontal bar covered with plastic foam to give it a non-slip surface for hanging trousers and other garments. U.S. Pat. No. 5,975,384 to Manabat discloses a clothes hanger with variable side attachments. U.S. Pat. No. 5,904,278 Barlow, et al. is a clothes hanger for hanging articles of clothing from the grab handles inside passenger cars. U.S. Pat. No. 5,893,493 to Noiray is a foldable clothes hanger. U.S. Pat. No. 5,975,305 is an extensible clothes hanger whose length conforms to the shoulder length of shirts, blouses, dresses, thereby eliminating unsightly stretch marks from fixed length hangers. U.S. Pat. No. 6,065,653 to Lin is a flexible clothes hanger that is adapted to suit clothes of different sizes. U.S. Pat. No. 5,971,237 to Timbrook discloses a height adjustable safety coat hanger. U.S. Pat. No. 5,927,571 to Richards is a convertible hanger for accommodating different sizes and styles of garments. Presently there is no invention, which attempts to utilize a coat hanger for identification purposes in adding a feature which displays information about the garment including but not limited to size.

Thus there is presently a need for the novel features possessed by the present invention.

BRIEF SUMMARY OF THE INVENTION

The present invention is a garment hanger with a window that displays the size of the garment. A cut out hole in the center of the hanger main body facilitates access to and display of a size indicator unit. Said unit may be turned manually to change the size being displayed through the window. A spring underneath said unit keeps said unit in place by providing enough pressure so that certain female and male couplings fit snugly into each other.

These together with other objects of the invention are pointed out clearly in the claims annexed to and forming a part of this disclosure. For a better understanding of the present invention, its operating advantages and the specific objects attained by its use, references should be made to the accompanying drawings and descriptive matter in which there are illustrated embodiments of the invention.

BRIEF DESCRIPTION OF THE DRAWINGS

For a better understanding of the nature of the present invention, reference should be made to the following detailed description taken in connection with the accompanying drawings wherein.

DETAILED DESCRIPTION OF THE PREFERRED EMBODIMENT

Figure 1:
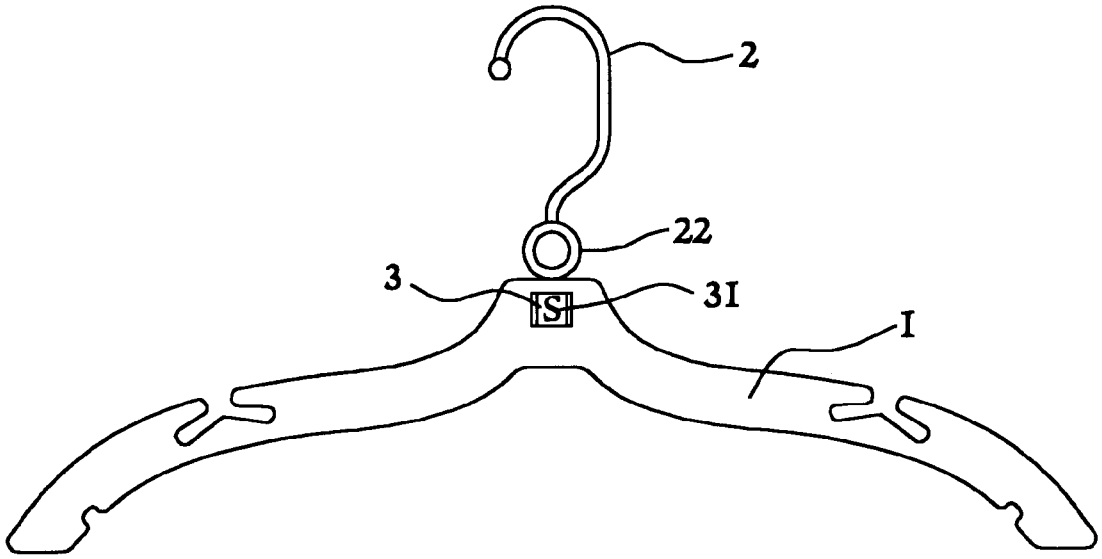
FIG. 1 is a perspective view of the present invenion.

Referring to FIG. 1, the preferred embodiment of the present invention comprises two horizontally-disposed arms extending outward from a central base. This forms the bottom base portion of a hanger generally referred to as 1. Bottom base portion 1 is joined to hook 2 by means of screw portion at the end of hook 2 which rotates into nut 5 at the center bottom of hanger base 1. Hanger hook 2 may be rotated 360 degrees and is used to suspend the rest of the hanger device and garment(s) hung thereon. Attached to hook 2 just above the top surface of hanger base 1 is a ring 22, which may hold additional hangers.

Figure 2:
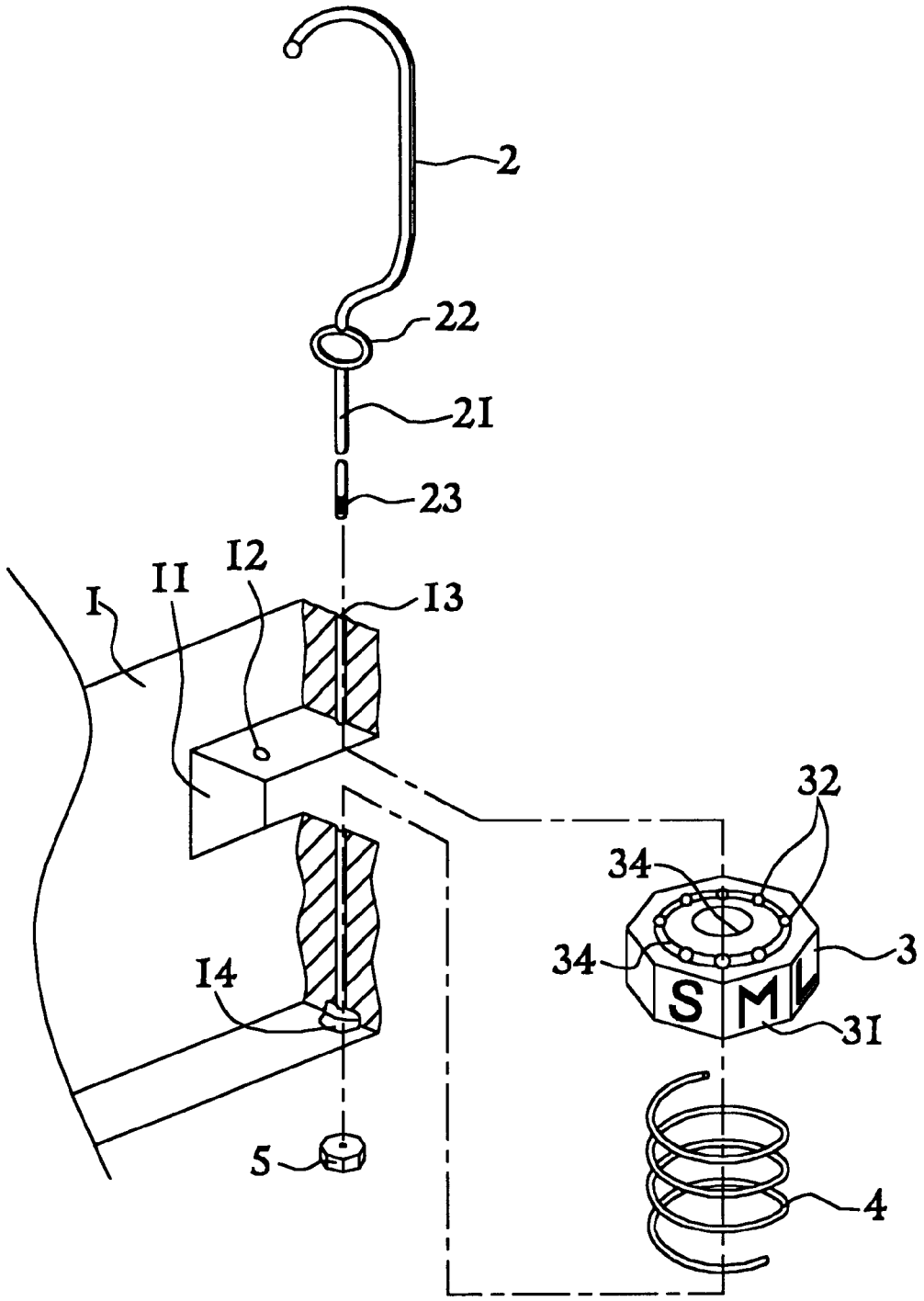
FIG. 2 is a dissected view of the present invention.

Referring now to FIG. 2, hook 2 extends further down from ring 22 as a thin cylindrical shaft 21, which is inserted into a cavity 13 formed within hanger base 1. Further down on shaft 21 is a screw portion 23, which forms an integral part of hook 2. 23 and 21 are inserted into cylindrical cavity 13 and pass through center hole 34 of the size indicator unit generally referred to as 3. Shaft 21 thereby keeping size indicator unit 3 horizontally affixed. Shaft 21 also passes through spring 3 located directly underneath and within size indicator unit 3. Shaft 21 is terminated by a screw portion 23 which rotates into nut 5 located within opening 14. Shaft 21 provides a means for all the subsequent items that it passes through to stay in place. This is especially important for size indicator 3 which is manually rotated and keeps its place by female and male coupler parts 31 and 12 respectively.

Figure 3:
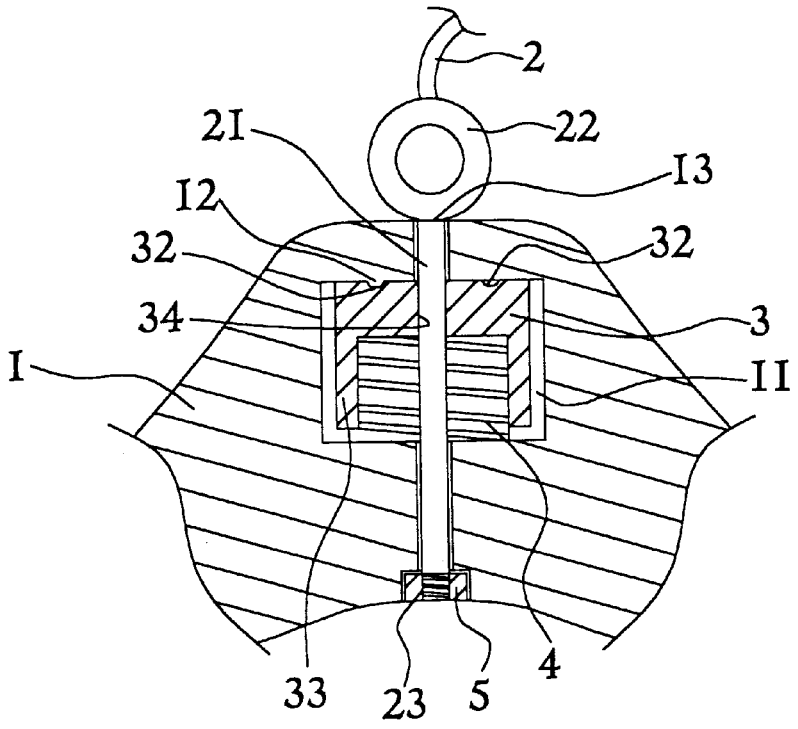
FIG. 3 is a close up view of the preferred embodiments of the present invention.

Referring now to FIG. 3, spring 4 is both underneath portions of size indicator 3 and contained within it in cavity 34 of unit 3. Spring 4 keeps unit 3 pressed up against top surface of opening 11 in hanger base 1 so that there is pressure between female coupler 32, which is an indenture on the top surface of size indicator unit 3, and male coupler 12, which is a protrusion roughly the same size as the indentures 32. This ensures a snug fit between 12 and 32 so that when the size indicator is set on one size, it remains in the same position until it is manually changed again.

Figure 4:
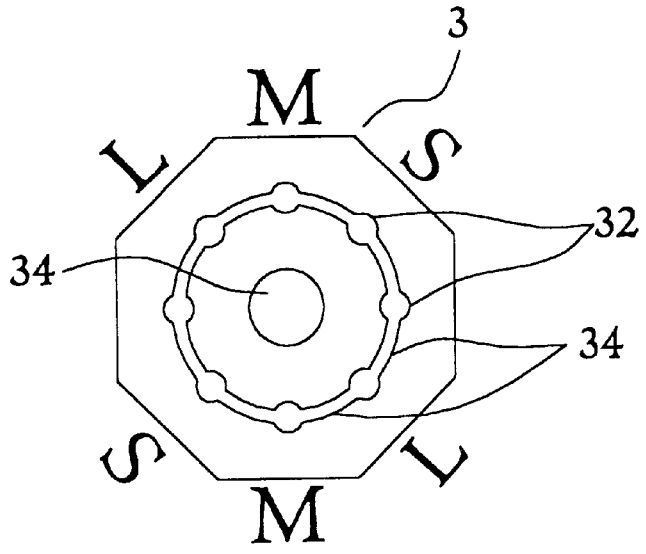
FIG. 4 is a top view of the size indicator unit

Referring to FIG. 4, the preferred embodiment includes eight sides to the size indicator unit 3. This octagonal shape ensures that each size is represented twice on the unit so that either side of window 11 of hanger base 1 will display the same size. For each size of the polygon, there is a female coupling indent 32 ready to mate with an opposing male coupling projection 12. When this occurs, the size indicator unit 3 is held in place by the tension created by the two parts pushing on one another. Each male coupler 32 is joined by a small rivulet engraved onto to top surface of size indicator unit 3. Such small engraving allow the male coupler projection 12 to slide horizontally along the spaces that connect the female couplers.

What is claimed is:

1. Garment hanger with window displaying size of the garment having:

A polygon shaped size indicator unit with different size representations written on each side of the polygon, including by not limited to XS, S, M, L, XL, 2, 3, 4 and the like;

A window opening located at the base hanger where said indicating unit is displayed;

A means for manually turning said indicator unit according to the different garments that are hung;

A means for keeping said indicator unit at fixed position in order to display a certain size by the use of female and male coupling parts that, by force of a spring pushing them against each other, lock into place.

2. Clothes hanger according to claim 1 wherein an additional ring is present on the body of the hanger to accommodate hanging of more garments on other hangers.

3. Garment hanger according to claim 1 wherein the garment hanger is made to hold garments other than shirts and coats, including but not limited to slacks, pants, skirts, belts and ties.

* * * * *